United States Patent [19]

Perédi

[11] 4,060,376

[45] Nov. 29, 1977

[54] METHOD OF FIRING AND FURNACE THEREFOR

[75] Inventor: Károly Perédi, Budapest, Hungary

[73] Assignee: Energiagazdalkodasi Intezet, Budapest, Hungary

[21] Appl. No.: 741,988

[22] Filed: Nov. 15, 1976

Related U.S. Application Data

[63] Continuation of Ser. No. 605,319, Aug. 18, 1975, abandoned.

[30] Foreign Application Priority Data

Dec. 11, 1974 Hungary ..... EE 2292

[51] Int. Cl.[2] ..... F23M 3/04; F27B 1/10

[52] U.S. Cl. ..... 432/24; 432/96; 431/10

[58] Field of Search ..... 432/24, 25, 99, 101, 432/128, 130, 133, 20; 431/10

[56] References Cited

U.S. PATENT DOCUMENTS

| | | | |
|---|---|---|---|
| 3,048,131 | 8/1962 | Hardgrove | 431/10 |
| 3,228,451 | 1/1966 | Fraser et al. | 431/10 |
| 3,421,824 | 1/1969 | Herbst | 431/10 |
| 3,727,562 | 4/1973 | Bauer | 431/10 |
| 3,746,498 | 7/1973 | Stengel | 431/10 |
| 3,816,063 | 6/1974 | Hicguet | 432/101 |

*Primary Examiner*—John J. Camby
*Assistant Examiner*—Henry C. Yuen
*Attorney, Agent, or Firm*—Young & Thompson

[57] ABSTRACT

Reasons of ecology, health and prevention of corrosion require firing methods and furnaces with which the contents of soot and uncombustible gases such as carbon monoxide, hydrogen, hydrocarbons as well as nitrogen oxides and sulfur trioxides do not excess certain levels. This is obtained by a firing method in which a fuel is decomposed with deficient amounts of primary combustion air to combustible gases. Such gases are combusted by the admixture of secondary and tertiary combustion air amounts whereby a flame is obtained which is extended in space and time and, thus, the temperature of which does not rise above moderate values such as 1400° centigrade. Prior to being exhausted, the combustion gases are thoroughly mixed so as to obtain perfect combustion of possibly subsisting combustible substances. Exhausting takes place with heat withdrawal so that cool and pure combustion gases enter the ambiency. The furnace suitable to carry out such method is distinguished by ceramic walls as well as a combustor at the inlet extremity of the furnace. At least one heat withdrawal means is provided downstream the combustor.

4 Claims, 9 Drawing Figures

METHOD OF FIRING AND FURNACE THEREFOR

This application is a streamlined continuation of application Ser. No. 605,319, filed Aug. 18, 1975, now abandoned.

This invention relates to a firing method and to a furnace for carrying out such method.

If combustion gases which withdraw from furnaces should comply with the norms of ecology, they must not contain excessive amounts of soot and uncombusted gases such as carbon monoxide, hydrogen and hydrocarbons. Neither should their content of nitrogen oxides and sulfur trioxides rise above a certain level. While soot and uncombusted gases as well as nitrogen oxides are undesired for reasons of ecology and health, sulfur trioxides may entail corrosion in recooler surfaces of boilers.

It has been suggested to decrease the content of soot and uncombusted gases by changing the fuel to combustion air ratio by means of increasing the amount of excessive combustion air. However, then, the power demand of the fans which supply such combustion air increases and, at the same time, the thermal efficiency of the furnace decreases. On the other hand, the amount of nitrogen oxide and sulfur trioxides becomes hardly smaller.

By decreasing the excessive amount of combustion air a greater air pressure is required for a thorough mixing of fuel and combustion air. While the power demand of the fans increases, and soot and uncombusted gases appear in the combustion products, the content of nitrogen oxides and sulfur trioxides decreases by a few percentages only.

Nitrogen oxides and sulfur trioxides are formed particularly with excessive air amounts and at temperatures of more than about 1400° C. Therefore, it has been suggested to employ furnaces with a gasifier in the form of a combustor with which combustion air is supplied in two stages. In the first stage combustion takes place with cooling down while combustion is obtained in the second stage only. In such manner, the current of nitrogen oxides could be diminished from about 500 parts pro million per normal cubic meter (ppm/$Nm^3$) by about 40 to 60 percentages. At the same time, the sulfur trioxide content remained essentially 150 parts pro million per normal cubic meter which means that it has not changed. Since about 1 part pro million nitrogen oxide ($NO_x$) and 10 parts pro million sulfur trioxide are already dangerous for health and therefore, undesired, the known furnaces with combustors have still not been suitable to meet all environmental and technical requirements.

A difficulty consists just in that an elimination of undesired components of the combustion gases depends on contrarious conditions. Viz., health protection requires a large amount of excessive combustion air while ecology points of view as well as protection of recooler surface of boiler equipment ask for possibly low surplus amounts thereof.

In addition, the specific mean heating surface efficiency of conventional furnaces is small so that they require considerable amounts of steel and much space.

The main object of the present invention is to eliminate the aforesaid inconveniences and, more particularly, to provide a firing method and a furnace therefor with which ecology and health protection requirements are essentially complied with at a maximum of efficiency and with a minimum need of space and construction material. Thus, the invention aims at complete combustion of combustible substances and gases which are formed while fuels are combusted at a low temperature of the resulting flame. In contrast to conventional furnaces with concentrated combustion the invention provides a gradual combustion which takes place in a plurality of stages extended in space and time as is the case with known furnaces provided with combustors. However, the gradual combustion according to the invention is carried out in such a manner that between individual stages the combustion gases are suitably cooled down, while the flame is maintained. Furthermore, prior to their withdrawal the combustion gases are thoroughly mixed. By such mixing, a complete combustion is obtained even in case of little excess air factors such as 1.02 to 1.04. Altogether, a complete combustion of possibly subsisting combustible substances such as carbon particles and combustible gases will be obtained at considerably reduced fan performances. The flame which is rich in carbon particles and, therefore, is strongly glowing will yeald practically about 65 to 75% of its useful heat content in the form of radiation at temperatures of about 700° to 900° C. so that but 25 to 35 percentages thereof will be transferred to convective heat consumers with their much lower heat transfer coefficients.

Thus, the invention is concerned above all with a method of firing for heat consuming equipments such as boilers and industrial furnaces comprising the steps of decomposing a fuel in the presence of deficient amounts of primary combustion air so as to produce a hot combustible gas, gradually combusting said hot combustible gas by means of secondary and tertiary combustion air to combustion gases and exhausting said combustion gases with heat withdrawal. The invention consists in that the hot combustible gases are cooled down by at least 50° C. to a temperature of more than 650° C. prior to introducing secondary combustion air, and mixing the hot combustion gases without heat withdrawal at a temperature of more than 650° C. prior to their being exhausted.

Tertiary combustion air may be supplied in more than one stages whereby combustion gases become alternately cooled down and warmed up. Thus, the temperature of combustion can be kept between moderate values and its maximum will preferably not exceed 1400° C. This means that practically no nitrogen oxides and sulfur trioxides will be formed.

The method according to the invention will preferably be carried out by a furnace having a flame channel consisting, in a manner known per se, of a gasifier device for decomposing a fuel at deficient amounts of combustion air, and of a combustion chamber provided with secondary and tertiary combustion air supply means and arranged for heat transfer to heat consuming means. The flame channel of such furnaces is, in compliance with the main feature of the present invention, at least partly confined by refractory ceramic walls and opens downstream of said combustion chamber into an uncooled mixing chamber, at least one heat withdrawal means being provided between the combustor and the combustion chamber of the furnace.

The invention will now be described in closer details by taking reference to the accompanying drawing which illustrates various exemplified embodiments of the furnace according to the invention and in which.

Same reference characters in the drawing refer to similar details.

Figure 1:
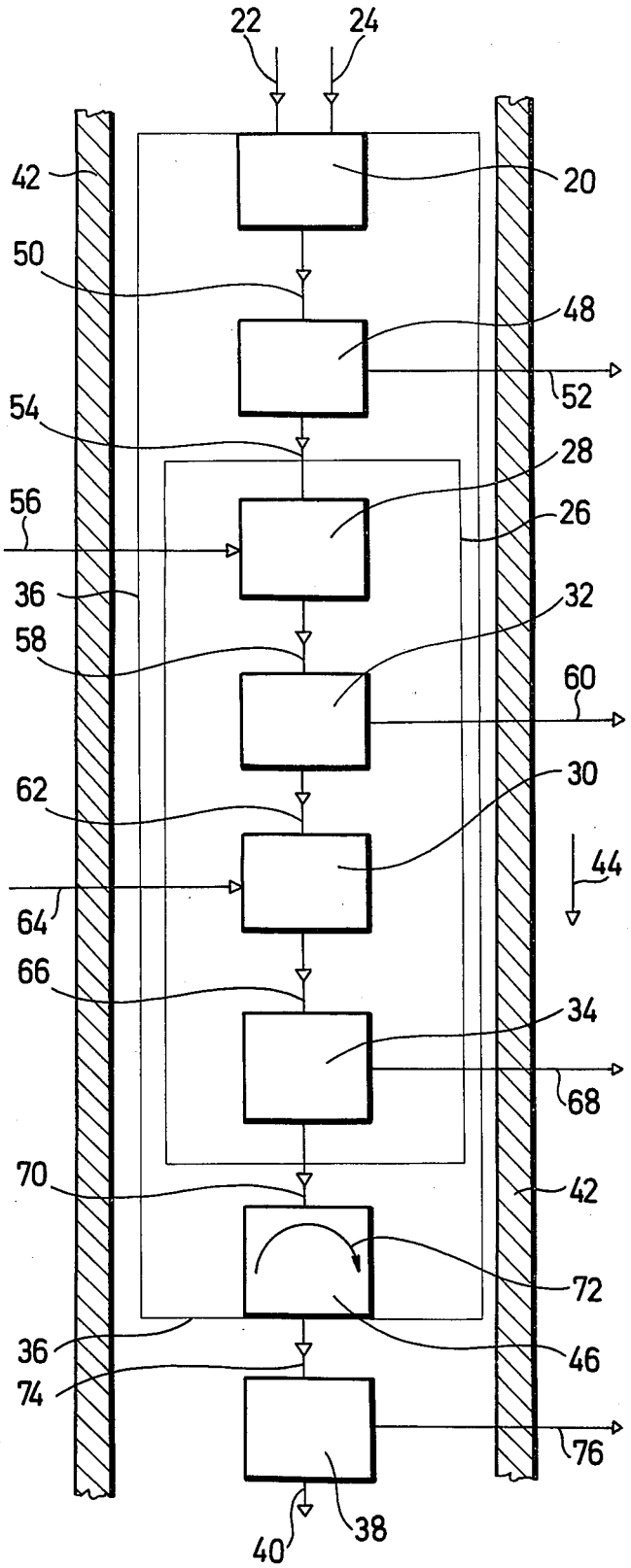
FIG. 1 is a block diagram of all units which are essential to the operativeness of a furnace according to the invention.

In the drawing, reference character 20 designates a gasifying means such as a combustor having a fuel inlet 22 and a primary combustion air supply means 24. The outlet of the gasifying means 20 is — through a unit to be described later — connected with a combustion chamber 26 which, in a manner known per se, is provided with a secondary combustion air supply means 28 and a tertiary combustion air supply means 30 with heat withdrawal means 32 and 34, respectively, provided downstream thereof. The entirety of the aforesaid units of gas forming and gas combusting means is designated by reference character 36 and will be, in the present specification and in the appended claims, referred to as a flame channel. The outlet, of the flame channel 36 is connected to a convective heat withdrawal means 38 the combustion gas outlet of which is designated by reference character 40.

The flame channel 36 of the furnace provided with its aforesaid and per se known parts is, in compliance with the main feature of the invention, confined by refractory ceramic walls 42 which, in the instant case extend through the whole length thereof, but might consist of spaced sections as well. According to a further main feature of the invention, the flame channel 36 opens downstream the combustion chamber 26 — viz., in the flow direction of combustion gases indicated by an arrow 44 — into an uncooled mixing chamber 46. According to a third and last main feature of the invention, a heat withdrawal means 48 is provided between the gasifying means 20 and the combustion chamber 26 in the flow path 44 of combustion gases.

The significance of the design of the furnace according to the invention has already been referred to. It consists in that fuel combustion occurs extended in space and time whereby a complete combustion is obtained without undesired high temperatures. The ceramic refractory walls 42 serve for maintaining the flame at moderate temperatures in the flame channel 36. Such features will now be described in closer details by describing the operation of the furnace according to the invention in general forms;

The gasifying means 20 will be supplied with e.g. oil through the fuel supply means 22. The primary combustion air supply means 24 serve for introducing primary combustion air. Fuel and combustion air amounts are selected so that a combustion at deficient amounts of combustion air takes place in the gasifying means 20 and a combustible hot gas is formed.

Such hot gas flows now in the direction indicated by an arrow 50 to the first heat withdrawal means 48 employed in compliance with the present invention. Such heat withdrawal means consists e.g. of boiler pipes or steamtubes by which the hot gas is considerably cooled down. Sizes and flow rates are selected so that a cooling down by at least 50° C. is obtained. Then, the temperature of the flowing gases will practically not exceed 1400° C. as is necessary for preventing the forming of nitrogen oxides. The heat withdrawal indicated by an arrow 52 serves, for instance, to evaporate water.

Having been cooled down in the first heat withdrawal means 48, the hot gas flows in the direction indicated by an arrow 54 towards and into the secondary combustion air supply means 28 of the combustion chamber 26 where the gas is further combusted in the presence of secondary combustion air in the form of an extended flame. The supply of secondary combustion air is indicated by an arrow 56.

The gas inflamed at the secondary combustion air supply means 28 flows in the direction indicated by an arrow 58 to the second heat withdrawal means 32 in which heat will be withdrawn from the flame as indicated by an arrow 60. However, also the ceramic walls 42 are heated by the glowing flame to incandescence so that on the one hand, the heat withdrawal means 32 is heated also by heat reflected from the walls 42 and, on the other hand, the flame subsists due to such reflection in spite of heat being withdrawn therefrom.

The cooled down flame proceeds from the second heat withdrawal means 32 in the direction indicated by an arrow 62 to the tertiary combustion air supply means 30 where it is mixed with tertiary combustion air the supply of which is indicated by an arrow 64.

While at the secondary combustion air supply means 28 combustion still takes place at deficient amounts of combustion air, the combustion at the tertiary combustion air supply means 30 occurs at surplus amounts of combustion air so that subsisting combustible gases will completely be combusted.

The combustion gases flow in the direction of an arrow 66 towards the third heat withdrawal means 34 where they will be cooled down as indicated by an arrow 68 whereafter they flow into the mixing chamber 46 in the direction indicated by an arrow 70.

Here, the combustion gases are thoroughly mixed — as indicated by an arrow 72 — and preferably at surplus amounts of combustion air and at temperatures of about 700° to 1000° C. with no heat withdrawal. Probably uncombusted gases, soot and carbon particles become completely combusted so that it is a flow of practically colourless and pure combustion gases which withdraws from the mixing chamber 46 in a direction indicated by an arrow 74. Such colourless and pure combustion gases flow into the convective fourth heat withdrawal means 38 where they yield their heat content as indicated by an arrow 76, e.g. through recooler surfaces, to heat consumers not shown. Obviously, instead of one single heat withdrawal means 38 a plurality thereof could be employed as well.

Figure 2:
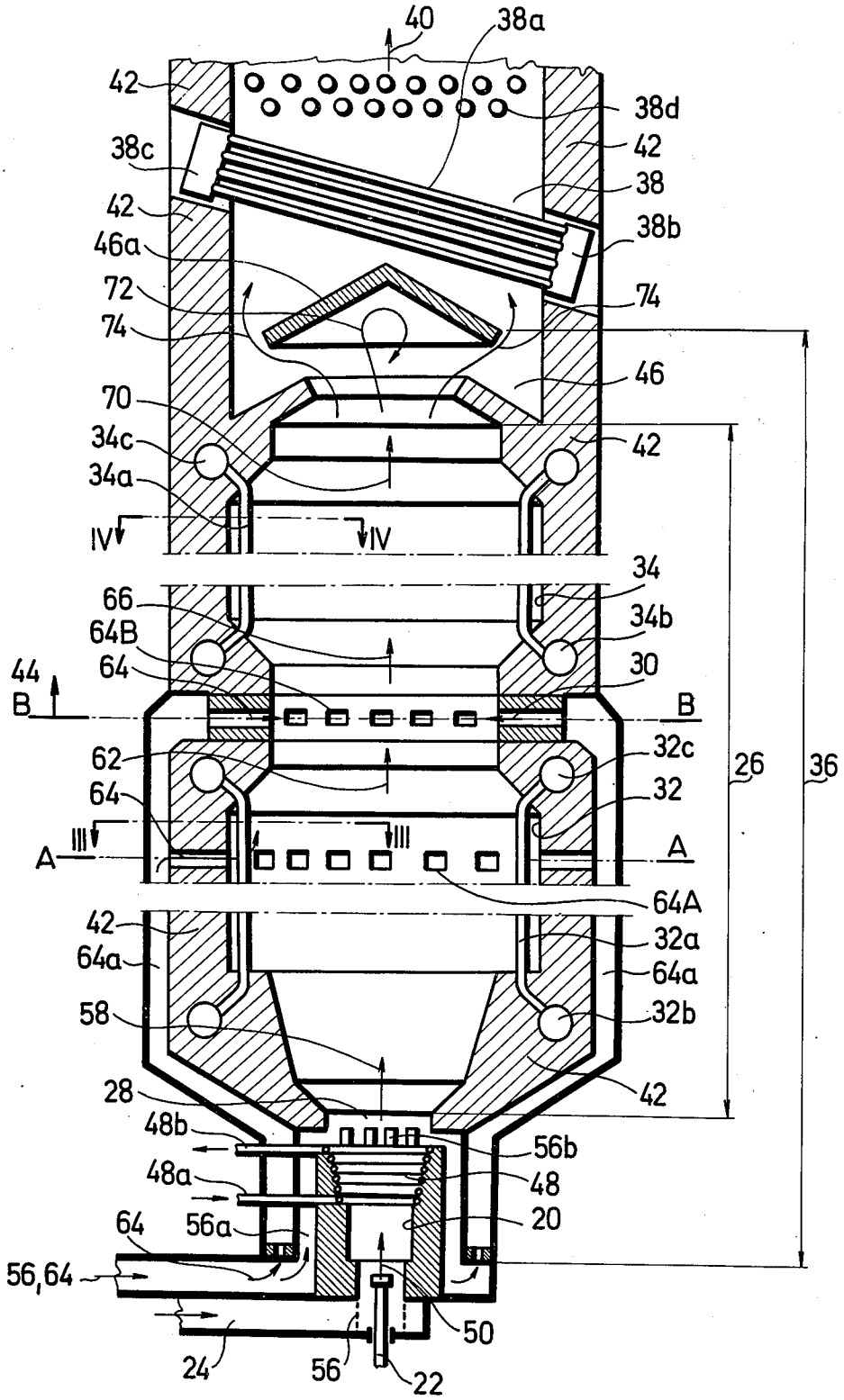
FIG. 2 shows a longitudinal sectional view of a vertical exemplified embodiment.
Figure 4:
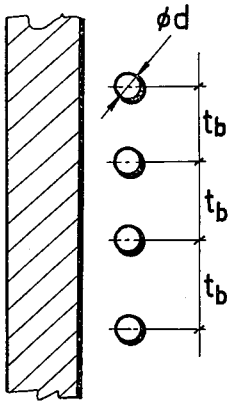

FIGS. 2 and 4 show an exemplified embodiment where the furnace according to the invention is formed as a boiler firing or boiler furnace.

The gasifying means 20 consist in a combustor with fuel supply means 22 and primary combustion air supply means 24. The first heat withdrawal means 48 employed in compliance with the invention is formed by a coil of pipe or water coil the inlet and outlet of which are referred to by reference characters 48*a* and 48*b*, respectively.

With the represented embodiment secondary combustion air 56 flows through channels 56*a* to the secondary combustion air supply means 28, the orifices of the channels 56*a* being designated by reference characters 56*b*.

The second heat withdrawal means 32 consists, in the instant case, in boiler pipes 32*a* connected to distributor pipe conduits 32*b* and 32*c*.

Tertiary combustion air 64 is supplied to the tertiary combustion air supply means 30 through channels 64*a* which, in the instant case, are branched off of the secondary combustion air supply conduit as indicated by arrows 56 and 64, respectively. Orifices of the tertiary combustion air conduits 64*a* at the tertiary combustion air supply means 30 are provided at a pair of levels A — A and B — B, and are referred to by reference characters 64A and 64B, respectively.

The third heat withdrawal means 34 consists likewise of pipes 34*a* with distributor pipe conduits 34*b* and 34*c*, respectively, which are associated with a superheater or evaporator not shown.

The mixing chamber 46 employed in compliance with the invention is, with the represented embodiment, formed as a simple cyclone.

In the instant case, the mixing chamber 46 has a pair of convective heat consumers connected to it downstream thereof which serve as a fourth heat withdrawal means 38. The first of them consists of evaporator or superheater pipes 38*a* with distributing and collecting chambers 38*b* and 38*c*, respectively, the pipes 38*a* being arranged under an angle of about 15° so as to ensure water circulation. The second heat consumer consists of pipes 38*d* e.g. of a feed water preheater with distributing and collecting chambers not shown.

It will be apparent that the units 20, 48, 28, 32, 30, 34, and 46, viz., the entire flame channel 36 lies generally between refractory ceramic walls 42 which glow in operation and, thus, irradiate also the sides of the pipe conduits 32*a* and 34*a* which face them and look away from the main stream of gases so that both the efficiency and the life period of the pipes conduits are considerably increased.

Figure 3:
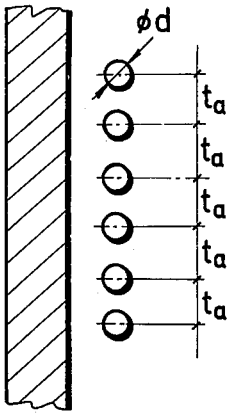
FIGS. 3 and 4 represent partial sectional views taken along lines III — III and IV — IV, respectively in FIG. 2.

Furthermore, both sectional views according to FIGS. 3 and 4 show that the ratio between the ceramic wall surfaces and irradiated pipe surfaces is greater downstream of the tertiary combustion air supply means 30 than upstream thereof. This means that, in the instant case, $t_b/d$ is greater than $t_a/d$, $d$ representing the diameter of the pipe conduits 32*a* and 34*a* whereas $t_a$ and $t_b$ represent the mutual distances of the pipe conduits in the heat withdrawal means 32 and 34, respectively. Thus, the heat radiation of the glowing ceramic walls 42 corresponds to the temperature drop across the tertiary combustion air supply means 30 in such a manner that where the temperature of the flame is smaller, less heat will be extracted by the pipe conduits 34*a* belonging to the third heat withdrawal means 34 downstream of the tertiary combustion air supply means 30 than by the pipe conduits 32*a* of the second heat withdrawal means 32 lying upstream the tertiary combustion air supply means 30. By such ratio, heat economy of the furnace according to the invention considerably increases and its operation becomes more reliable.

In operation, a fuel such as oil, gas, powdered coal or wood powder is supplied through the fuel supply means 22 into a reaction chamber of the gasifying means 20 where it is mixed with primary combustion air supplied through the primary combustion air supply means 24. Primary combustion air amounts but to about 20 to 40% of the theoretical value so that a decomposition of the fuel in the gasifying means 20 takes place at a deficient amount of combustion air and, dependent on the deficiency, a temperature of 800° to 1300° C. will prevail.

The resulting hot gas flows in the direction of the arrow 50 across the water conducting pipe coil of the first heat withdrawal means 48 and the gas is cooled down by an least 50° C. Thus, the gas enters the secondary combustion air supply means 28 at a temperature of about 800° C. so that in the course of further combustion its temperature will not surpass the value of 1400° C.

The amount of secondary combustion air supplied through the channels 56*a* and the orifices 56*b* will preferably be selected to about 65 to 45% of the theoretical total amount of combustion air. Thus, combustion at the secondary combustion air supply means 28 occurs likewise at a deficient amount of air which is here about 10 to 20% so that again a combustible gas is formed with a content of CO, $H_2$, CH and $C_nH_n$ as well as a great number of precipitated carbon particles which convert the gas flow into an intensly glowing flame. Forming of $NO_x$ and $SO_3$ will, at the same time, be effectively prevented by the relatively low gas temperature.

The heat content of the flame withdrawing from the secondary combustion air supply means 28 in the direction of the arrow 58 will irradiate both the boiler pipes 32*a* and the ceramic walls 42 in the second heat withdrawal means 32. As goes forth from the drawing, the glowing walls 42 of the second heat withdrawal means 32 irradiate, in turn, those sides of the boiler pipes 32*a* which face the side walls of the flame channel and look away from the gas flow 58. As has already been indicated, by such arrangement both, the capacity of the boiler pipes 32*a* and, due to their warming up uniformly, their period of lifetime will greatly be increased.

Glowing gases flow in the direction of the arrow 62 and reach the tertiary combustion air supply means 30 where they become mixed with tertiary combustion air supplied through the channels 64*a* and the orifices 64A and 64B. The amount of tertiary combustion air is selected so as to yield only little air excess which suffices to obtain complete combustion. Combustion gases flowing in the direction of the arrow 66 yield their heat content to the pipe conduits 34*a* of the third heat withdrawal means 34 by radiation. Thus, a long extended flame of a moderate temperature of maximum about 1400° C. will be obtained so that practically neither $NO_x$ nor $SO_3$ will be formed. The flame gradually extinguishes and its temperature sinks to about 700° to 900° C.

The gases withdrawing from the third heat withdrawal means 34 in the direction of the arrow 70 arrive in the mixing chamber 46 provided in compliance with the invention. Here, the gases strike against the ceiling 46*a* of the mixing chamber 46 as indicated by an arrow 72. Consequently, soot particles and uncombusted gas components which possibly still subsist in the extinguishing flame contact with unconsumed combustion air and become completely combusted at temperatures prevailing here and amounting to about 700° to 900° C. Thus, moderate air excesses may be employed, without the risk of too high local temperatures such as 1600° to 1800° C. which are, otherwise, inavitable with convennional boiler firings. In addition, small fan capacities will suffice for the desired mixing of combustion gases and remnants of combustion air.

The combustion gases withdrawing from the mixing chamber 46 are practically free of soot, carbon monoxide and hydrocarbons. Moreover, they contain but very little $NO_x$ and $SO_3$. The gases flow to the fourth heat withdrawal means 38 where their temperatures of above 650° C. decrease to the usual values of about 150° C. Thus, cooled down and pure combustion gases will be exhausted from the furnace in the direction of the arrow 40 into the ambiency.

The average specific heat performance (kilo calories per square meter and hour = Kcal/m²,h) of the furnace according to the invention is considerably increased with respect to conventional boiler firings since — according to calculations — instead of 38 to 40% of suseful heat (kilo calories per hour = Kcal/h) actually 68 to 73% thereof are yielded in form of radiation energy to heating surfaces so that the much smaller specific heat performances of convective heating surfaces are less decisive. Moreover, the flow resistance in the path of the combustion gases in the flame channel 36 is likewise much smaller than with conventional furnaces because the number of pipe conduit rows is smaller in the direction of the combustion gas flow than with known arrangements. Since the percental participation of convective heating surfaces is, at similar heat performance, considerably less. Moreover, the size of the banks of convective pipe conduits in the direction of the pipe axes is always greater than both their other sizes which are transversal of the flow direction.

Figure 5:
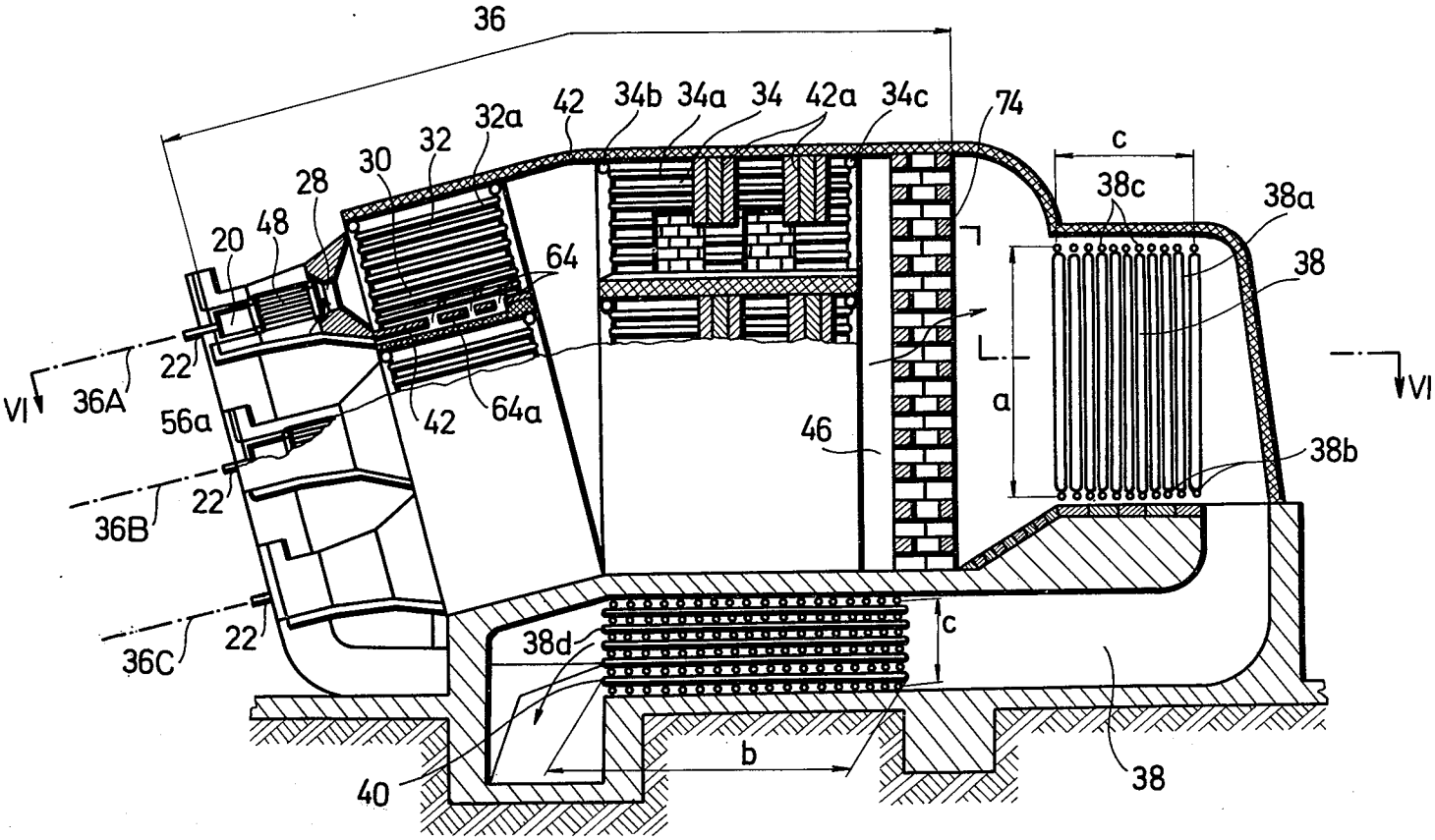
FIG. 5 illustrates a longitudinal sectional view of a horizontal exemplified embodiment of the furnace according to the invention taken along lines V — V in FIG. 6.
Figure 6:
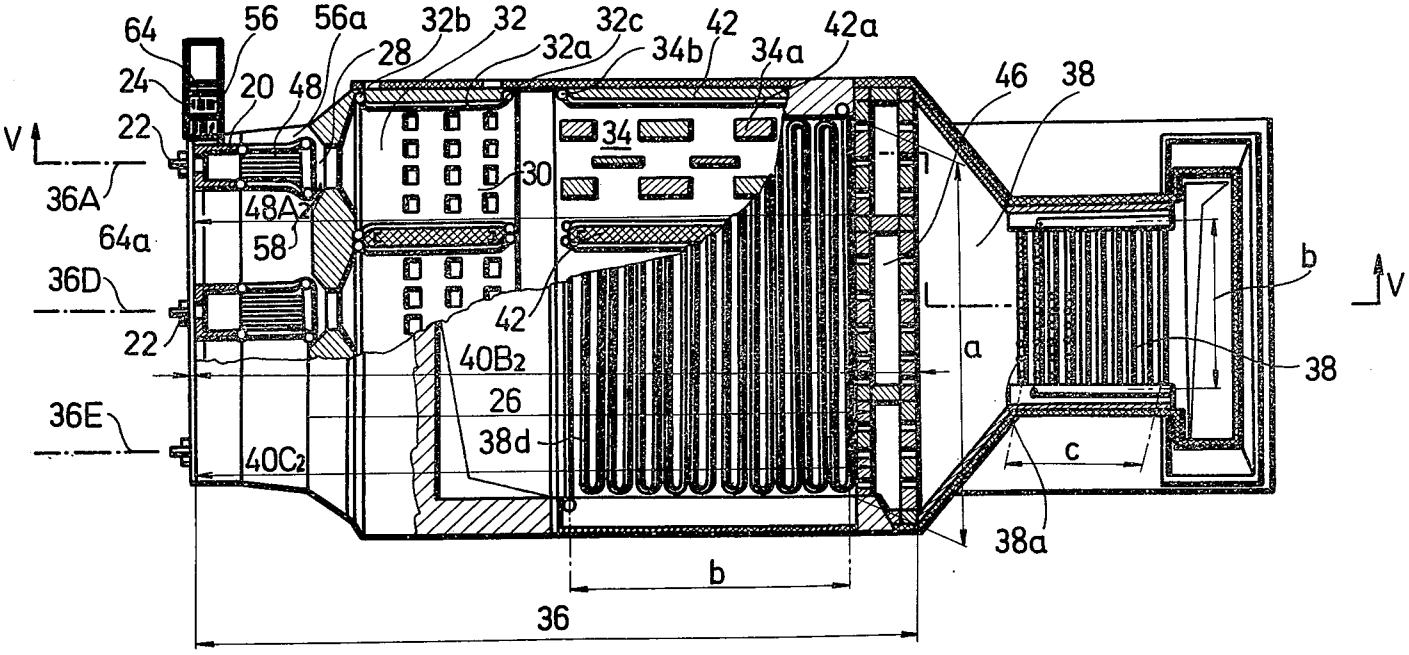
FIG. 6 is a sectional view taken along line VI — VI in FIG. 5.

FIGS. 5 and 6 show an exemplified embodiment which is formed as a horizontal furnace and is distinguished from the previous one by that several flame channels open into a single mixing chamber. With the represented embodiment six flame channels are provided of which three flame channels are shown in FIG. 5 and two further flame channels are represented in FIG. 6 and suggested by their axes 36A, 36B and 36C, and by 36D and 36E, respectively. Already explained details are referred to in case of the flame channel 36A by reference characters of the vertical exemplified embodiment according to FIG. 2 where a single flame channel 36 was employed. As can be seen, the mixing chamber 46 forms a section of all flame channels 36A etc. whereby again space and investment costs could be economized.

A further feature of the represented embodiment consists in that the difference in the ratio of ceramic wall surface to irradiated pipe conduit surface downstream and upstream of the tertiary combustion air supply means is obtained by surface increasing extensions 42*a* of the ceramic wall 42 rather than by different spacings of the pipe conduits 32A and 34A. Thus, it is possible to employ pipe conduit banks of essencially similar design.

The heat withdrawal means 38 connected downstream to the mixing chamber 46 is again built up of pipe conduits 38*a* and 38*d*. The dimension *a* of the convective heat withdrawal means in the direction of the pipe conduits 38*a* and 38*d* is greater than transversely thereof. Transverse dimensions are referred to by *b* and *c*, respectively. This means that *a* is always greater than *b* and *c*. Such dimension ratios permit to employ a small number of pipe conduit rows which lie in the flow direction 44 so that also the flow resistance in the path of the combustion gases is correspondingly small.

Figure 7:
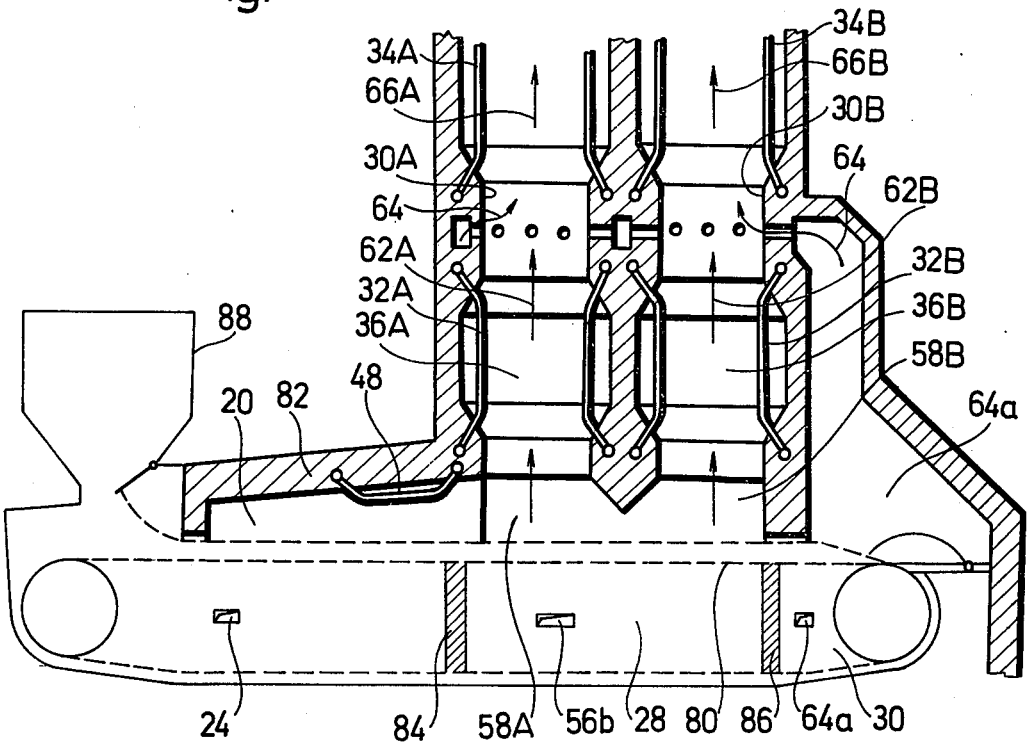
FIG. 7 shows a vertical sectional view of another exemplified embodiment.

FIG. 7 shows an exemplified embodiment with which the furnace according to the invention appears in the form of a stoker. In the instant case, the stoker is provided with two flame channels 36A and 36B and with a common gasifying means 20, first heat withdrawal means 48 and secondary combustion air supply means 56*b*. Beneath the second heat withdrawal means 32A and 32B of the flame channels 36A and 36B, respectively, there is a chain-type travelling grate or chain grate 80 which, towards its front extremity, extends underneath an ignition and gasification vault. 82, and towards its rear extremity opens into a channel 64*a* which serves for supplying tertiary combustion air. Primary combustion air is introduced between the strands of the chain grate 80 through the primary combustion air supply means 24 which is separated from the secondary combustion air supply means 28 by a partition 84. The secondary combustion air supply means 28 is, in turn, separated from the tertiary combustion air supply means 30 by a partition 86 which is likewise between the strands of the chain grate 80. Coal is supplied to the chain grate 80 in a manner known per se through a bunker 88.

In operation, granular coil is supplied from the bunker 88 onto the chain grate 80 and becomes ignited and gasified by the ignition and gasification vault 82. The process of ignition and gasification which occur at deficient amounts of combustion air in the already described manner corresponds to the decomposition of gas as has been described e.g. in connection with the exemplified embodiment illustrated in FIGS. 2 to 4 though with the difference that, in the instant case, it is coal which is reacted as fuel with incoming primary combustion air. Thus, the gasifying means 20 consists here, of the section of the chain grate 80 in front of the partition 84 and the uncooled section of the ignition and gasification vault 82.

The first heat withdrawal means 48 is formed by a bank of pipe conduits provided at the outlet extremity of the ignition and gasification vault 82.

Gases withdrawing from the first heat withdrawal means 48 meet the introduced secondary combustion air flowing from the orifices 56*b* between the partitions 84 and 86. They become ignited in the already described manner and flow in the direction of the arrows 58A and 58B into the second heat withdrawal means 32A and 32B, respectively.

The next section of flow path of the gases consists in the tertiary combustion air supply means 30A and 30B, respectively. Here, tertiary combustion air is introduced from the channel 64*a* into the gas streams. Carbon particles carried away behind the partition 86 from the curved section of the chain grate 80 become likewise glowing and combusted.

As to the further development of the combustion process, reference may be taken to the description of the operation of the exemplified embodiment illustrated in FIGS. 2 to 4.

Figure 8:
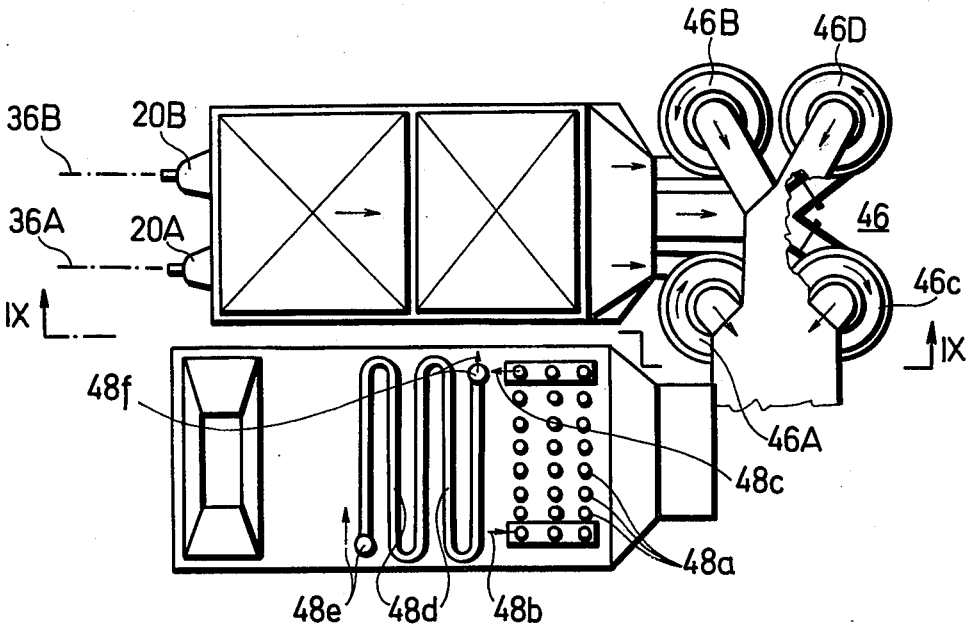
FIG. 8 illustrates a plan view of a further exemplified embodiment of the furnace according to the invention.
Figure 9:
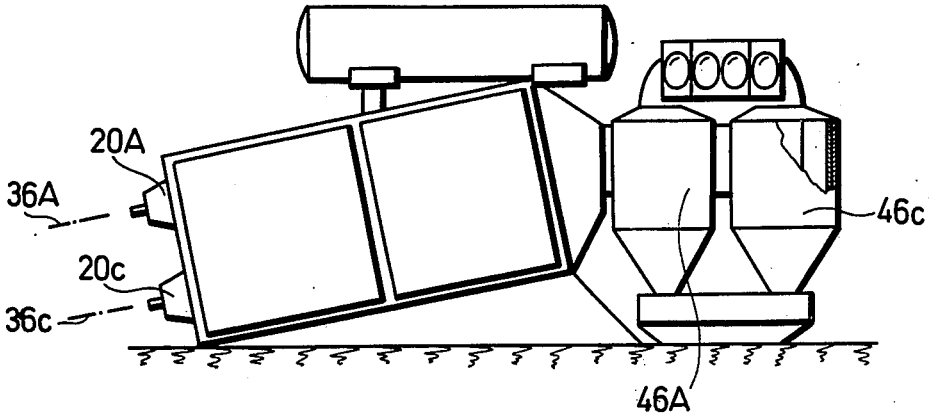
FIG. 9 is a vertical sectional view taken along line IX — IX in FIG. 8.

The exemplified embodiment shown in FIGS. 8 and 9, is formed as a furnace with four gasifying means of which three are indicated by reference characters 20A, 20B and 20C in the drawing. They are supplied with coal powder. Corresponding four flame channels 36A etc. open each into a multi cyclone which, in the instant case, serve as the mixing chamber 46 of the former exemplified embodiments and are referred to by reference characters 46A, 46B, 46C and 46D respectively. By forming the mixing chamber as a group of cyclone 46A, 46B, 46C and 46D an efficient precipitation of flue dust, abundantly present in coal powder firings, is obtained. Moreover, it is rendered possible to employ an electro filter known per se and, therefore, not illustrated in the drawing. Such electro filter may be provided downstreamm of a likewise not illustrated convective fourth heat withdrawal means. Such arrangement ensures a desired purity of the withdrawing combustion gases.

What we claim is:

1. A method of firing for heat consuming equipment such as boilers and industrial furnaces comprising decomposing a fuel in a first stage in the presence of deficient amounts of primary combustion air so as to produce a hot combustible gas, gradually combusting said hot combustible gas in a second stage by means of secondary combustion air also in deficient amount for complete combustion and in a third stage with tertiary air in an amount for complete combustion, and exhausting said combustion gases with heat withdrawal, cooling down said hot combustible gas by at least 50° C. to a temperature of more than 650° C. prior to introducing said secondary combustion air, and mixing said combustion gases without heat withdrawal at a temperature of more than 650° C. prior to their being exhausted.

2. In a method as claimed in claim 1, the further improvement of supplying said tertiary combustion air in a plurality of stages so as to alternately cool down and warm up said combustion gases.

3. In a method as claimed in claim 2, the still further improvement of warming up said combustion gases to a temperature of maximum 1400° C.

4. In a method as claimed in claim 1 the further improvement of carrying out the mixing of the combustion gases in the presence of excess air at a temperature of 700° to 1000° C.

* * * * *